US008506025B2

(12) United States Patent
Kim

(10) Patent No.: US 8,506,025 B2
(45) Date of Patent: Aug. 13, 2013

(54) SUPPORTER AND PEDESTAL AND WASHING/DRYING MACHINE HAVING THE SAME

(75) Inventor: Hyun-Seok Kim, Gyeongsangham-Do (KR)

(73) Assignee: LG Electronics Inc., Seoul (KR)

( * ) Notice: Subject to any disclaimer, the term of this patent is extended or adjusted under 35 U.S.C. 154(b) by 389 days.

(21) Appl. No.: 12/676,104

(22) PCT Filed: Sep. 3, 2008

(86) PCT No.: PCT/KR2008/005187
§ 371 (c)(1),
(2), (4) Date: Mar. 2, 2010

(87) PCT Pub. No.: WO2009/031815
PCT Pub. Date: Mar. 12, 2009

(65) Prior Publication Data

US 2010/0201236 A1 Aug. 12, 2010

(30) Foreign Application Priority Data

Sep. 3, 2007 (KR) ..... 10-2007-0089184

(51) Int. Cl.
*A47B 77/02* (2006.01)

(52) U.S. Cl.
USPC ..... 312/228; 312/351.2

(58) Field of Classification Search
USPC ..... 312/107, 228, 257.1, 351.1, 351.2, 312/352; 248/188.1, 188.5, 188, 346.01–346.03, 346.3, 248/346.5, 635, 639, 678, 680
See application file for complete search history.

(56) References Cited

U.S. PATENT DOCUMENTS

| | | | | |
|---|---|---|---|---|
| 3,212,739 | A * | 10/1965 | Morris | 248/681 |
| 4,124,958 | A * | 11/1978 | Chiche | 312/140 |
| 6,126,131 | A * | 10/2000 | Tietz | 248/346.01 |
| 6,427,966 | B1 * | 8/2002 | Blumenschein | 248/678 |
| 7,219,609 | B1 * | 5/2007 | Utz et al. | 108/57.21 |
| 2002/0145097 | A1 * | 10/2002 | Bruschi et al. | 248/346.01 |
| 2003/0057342 | A1 * | 3/2003 | Johanson et al. | 248/346.02 |
| 2004/0245899 | A1 | 12/2004 | Cho | |
| 2005/0275325 | A1 * | 12/2005 | Yang | 312/330.1 |
| 2006/0103281 | A1 * | 5/2006 | Cho | 312/351.2 |
| 2007/0187564 | A1 * | 8/2007 | McGuire | 248/346.5 |

FOREIGN PATENT DOCUMENTS

| | | | |
|---|---|---|---|
| CN | 1683673 | A | 10/2005 |
| CN | 1715518 | A | 1/2006 |
| KR | 10-2004-0053623 | A | 6/2004 |
| KR | 10-2004-0085516 | A | 10/2004 |
| KR | 10-2004-0086059 | A | 10/2004 |
| KR | 10-2005-0118612 | A | 12/2005 |
| KR | 10-2005-0118893 | A | 12/2005 |
| KR | 10-2006-0120936 | A | 11/2006 |

* cited by examiner

*Primary Examiner* — Darnell Jayne
*Assistant Examiner* — Matthew Ing
(74) *Attorney, Agent, or Firm* — Birch, Stewart, Kolasch & Birch, LLP

(57) ABSTRACT

A washing/drying machine is mounted to a pedestal via supporters. The pedestal includes a housing having a specific space therein, the plurality of supporters mounted at the housing and supporting an object placed on the housing and connection parts connecting the supporters mounted at one side of the housing to each other. The supporters are provided with coupling ribs for fixing the object at the housing. As the pedestal is mounted at the washing/drying machine, it is capable of preventing surfaces of the washing/drying machine and the pedestal from being damaged and of preventing water or other foreign materials from penetrating through a gap between the washing/drying machine and the pedestal by the connection parts mounted between the washing/drying machine and the pedestal.

7 Claims, 7 Drawing Sheets

SUPPORTER AND PEDESTAL AND WASHING/DRYING MACHINE HAVING THE SAME

TECHNICAL FIELD

The present invention relates to a washing/drying machine, and more particularly, to supporters, a pedestal having the same and a washing/drying machine, in which the supporters for mounting a pedestal at a washing/drying machine are provided with connection parts for shielding a gap between the pedestal and the washing/drying machine and don't require additional coupling members.

Particularly, the present invention is more suitable for a product sold under a state that the pedestal and the washing/drying machine are coupled to each other.

BACKGROUND ART

Generally, a washing/drying machine serves to remove pollutants remaining on clothes, bedclothes, etc. (hereafter, referred to as 'laundry') and includes a washing machine for washing the laundry, a drying machine for drying the laundry and a washing and drying machine (i.e., washing machine combined dryer) for executing both washing and drying operation. Also, recently, a refresher has been developed to remove wrinkles on the laundry or to perfume the laundry.

Meanwhile, the current washing/drying machine is provided with a pedestal for storing needed items therein. Such washing/drying machine including the washing machine, the drying machine and the washing and drying machine is configured to be fixed over the pedestal.

FIG. 1 is an exploded perspective view showing a washing/drying machine at which a pedestal is mounted in the related art. As shown in FIG. 1, the pedestal 20 includes a housing 21 having a specific space therein and a storage drawer 22 detachably inserted into the housing 21 so as to store various items therein.

Here, a main body 10 of the washing/drying machine 1 and the pedestal 20 are coupled to each other using additional coupling members 23 such as a bracket. Each coupling member 23 has an upper end 23*a* fixed at one side surface of the washing/drying machine main body 10 by a double-sided tape 24 and has a lower end 23*b* fixed at one side surface of the housing 21 of the pedestal 20 by screws 25.

Here, two coupling members 23 are respectively installed at both side surfaces of the main body 10 of the washing/drying machine 1 and the housing 21 of the pedestal 20. Each coupling member 23 has the upper end 23*a* attached by the double-sided tape 24 and both sides of the lower end 23*b* coupled by the screws 25 so as to connect one side surface of the lower end of the main body 10 forming an external appearance of the washing/drying machine 1 to one side surface of the housing 21 of the pedestal 20.

However, in the related pedestal 20, in case that the coupling members 23 are removed so as to move the washing/drying machine 1 or to install another washing/drying machine 1 over the pedestal, marks of the double-sided tape 24 or holes by the screws 25 may remain on the washing/drying machine 1 or the pedestal 20. Also, in an unscrewing process for removing the coupling members 23, a surface of the washing/drying machine 1 or the pedestal 20 may be sunken or the coupling members 23 may be bent.

And, when a product has been sold under a state that the washing/drying machine 1 and the pedestal 20 are coupled to each other, the pedestal 20 may be separated from the washing/drying machine 1 while moving or installing the product due to a weak coupling force therebetween.

Also, the coupling members 23 for coupling the washing/drying machine 1 and the pedestal 20 to each other may be exposed out, which causes a user's sense of beauty to be degraded.

In addition, water or other foreign materials may penetrate through a gap generated between the washing/drying machine 1 and the pedestal 20, which causes the surface of the product to be corroded.

Further, since the coupling members for coupling the washing/drying machine 1 and the pedestal 20 to each other are mounted at the outside of the pedestal 20 and the washing/drying machine 1 and there is no component serving as a bumper between the washing/drying machine 1 and the pedestal 20, a load of the washing/drying machine 1 may be directly transferred to the pedestal 20, which causes the pedestal 20 to be deformed.

DISCLOSURE OF THE INVENTION

Technical Problem

Therefore, it is an object of the present invention to provide supporters capable of preventing surfaces of a washing/drying machine and a pedestal from being damaged, by installing the supporters and connection parts between the washing/drying machine and the pedestal and coupling ribs formed at the supporters and base side coupling ribs formed at a base supporting a lower portion of the washing/drying machine to each other, and a pedestal having the same Further, it is another object of the present invention to provide supporters which are capable of preventing a pedestal from being separated from a washing/drying machine when moving or installing a product resulting from that a coupling force between the washing/drying machine and the pedestal is strongly maintained when the product has been sold under a state that the washing/drying machine and the pedestal are coupled to each other and of preventing a user's sense of beauty from being degraded due to outwardly exposed coupling members for coupling the washing/drying machine and the pedestal to each other, by installing the supporters provided with a plurality of coupling holes and connection parts between the washing/drying machine and the pedestal, a pedestal having the same and a washing/drying machine.

Further, it is still another object of the present invention to provide a pedestal having supporters capable of preventing water or other foreign materials from penetrating through a gap between a washing/drying machine and the pedestal, and a washing/drying machine.

Further, it is yet still another object of the present invention to provide a pedestal which is capable of lessening a load of a washing/drying machine directly transferred to the pedestal by installing supporters and connection parts between the washing/drying machine and the pedestal, and a washing/drying machine having the same.

Technical Solution

To achieve these objects, there is provided a pedestal comprising a housing having a specific space therein, a plurality of supporters mounted at the housing and supporting an object placed on the housing and connection parts connecting the supporters mounted at one side of the housing to each other. The supporters are provided with coupling ribs for fixing the object at the housing.

Here, the supporters comprise a plurality of supporting plates on which the object is mounted, the plurality of coupling ribs respectively formed at one side of each supporting plate and coupling the object and the supporting plates to each other and the connection parts connecting the supporting plates to each other.

Accordingly, it is capable of preventing the pedestal from being separated from a washing/drying machine when moving or installing a product even when the washing/drying machine has been sold under a state that the pedestal is mounted at the washing/drying machine.

And, the supporting plates of the supporters mounted at one side of the housing may be integrated with the connection parts, accordingly it is capable of enhancing productivity of the supporters and of reducing time taken to respectively mount the supporting plates of the supporters and the connection parts.

Each supporter is provided with a leg guide hole for receiving a leg of the object and a shield wall for preventing the leg from being outwardly exposed.

Here, a height of the shield wall may be same as a height of the supporter, accordingly it is capable of more perfectly preventing the leg of the object from being outwardly exposed.

And, the leg guide hole may be partially protruded more than the shield wall, accordingly it is capable of reducing an entire size of the supporter.

Meanwhile, the height of the shield wall may be lower than that of the supporter and the leg guide hole may be partially opened. Accordingly, it is capable of coping with a size of the leg by the opened portion of the leg guide hole even when the leg of the object is partially exposed out. That is, even if the size of the leg guide hole is slightly smaller than that of the leg, it is capable of smoothly mounting the leg by the opened portion.

And, each supporter may be provided with a plurality of reinforcing ribs so as to reduce the amount of materials needed to fabricate the supporter and to reinforce strength of a peripheral portion of the leg guide hole.

Meanwhile, to achieve these objects, there is also provided a washing/drying machine comprising a washing/drying machine main body executing washing or drying operation for laundry, a base coupled to a lower end of the main body so as to support the main body and provided with legs, and a pedestal installed at a lower side of the main body and supporting the main body. The pedestal has an upper surface provided with a plurality of supporters provided with coupling ribs for fixing the washing/drying machine main body at the pedestal and connection parts connecting the supporters mounted at one side of the pedestal to each other.

Here, the base is provided with base side coupling ribs coupled to the coupling ribs of the supporters. Accordingly, it is not required to mount additional coupling members at an outer surface of a product so as to couple the washing/drying machine to the pedestal.

And, the supporters mounted at one side of the pedestal and the connection parts are integrally formed. Each supporter is provided with a leg guide hole for receiving the leg and a shield wall so as to prevent the leg from being exposed out.

Here, the leg guide hole is partially protruded more than the shield wall or partially opened.

The connection parts serve to shield a gap between the pedestal and the main body.

Advantageous Effects

As aforementioned, in the present invention, the plurality of supporters and the connection parts connecting the supporters to each other are mounted between the washing/drying machine and the pedestal and then the coupling ribs formed at the supporters and the base side coupling ribs formed at the base supporting the lower portion of the washing/drying machine are coupled to each other, accordingly it is capable of preventing surfaces of the washing/drying machine and the pedestal from being damaged.

Also, in the present invention, using the supporters and the connection parts, it is capable of preventing the pedestal from being separated from the washing/drying machine when moving or installing the washing/drying machine, which may be caused by a weak coupling force, even if the washing/drying machine has been sold under a state that the pedestal is mounted at the washing/drying machine. And, as the supporters and the connection parts for coupling the washing/drying machine and the pedestal to each other are not exposed out, it is capable of implementing an excellent external appearance of the product.

Further, in the present invention, as the connection parts are interposed between the washing/drying machine and the pedestal, it is capable of preventing water or other foreign materials from penetrating through the gap between the washing/drying machine and the pedestal.

Further, in the present invention, the supporters and the connection parts are interposed between the washing/drying machine and the pedestal, accordingly it is capable of lessening a load of the washing/drying machine directly transferred to the pedestal, thereby capable of preventing the pedestal from being deformed or damaged.

MODES FOR CARRYING OUT THE PREFERRED EMBODIMENTS

Description will now be given in detail of the preferred embodiment of the present invention, examples of which are illustrated in the accompanying drawings.

Detailed explanation about well-known functions or configurations will be omitted so as to implement the present invention more explicitly.

Figure 1:
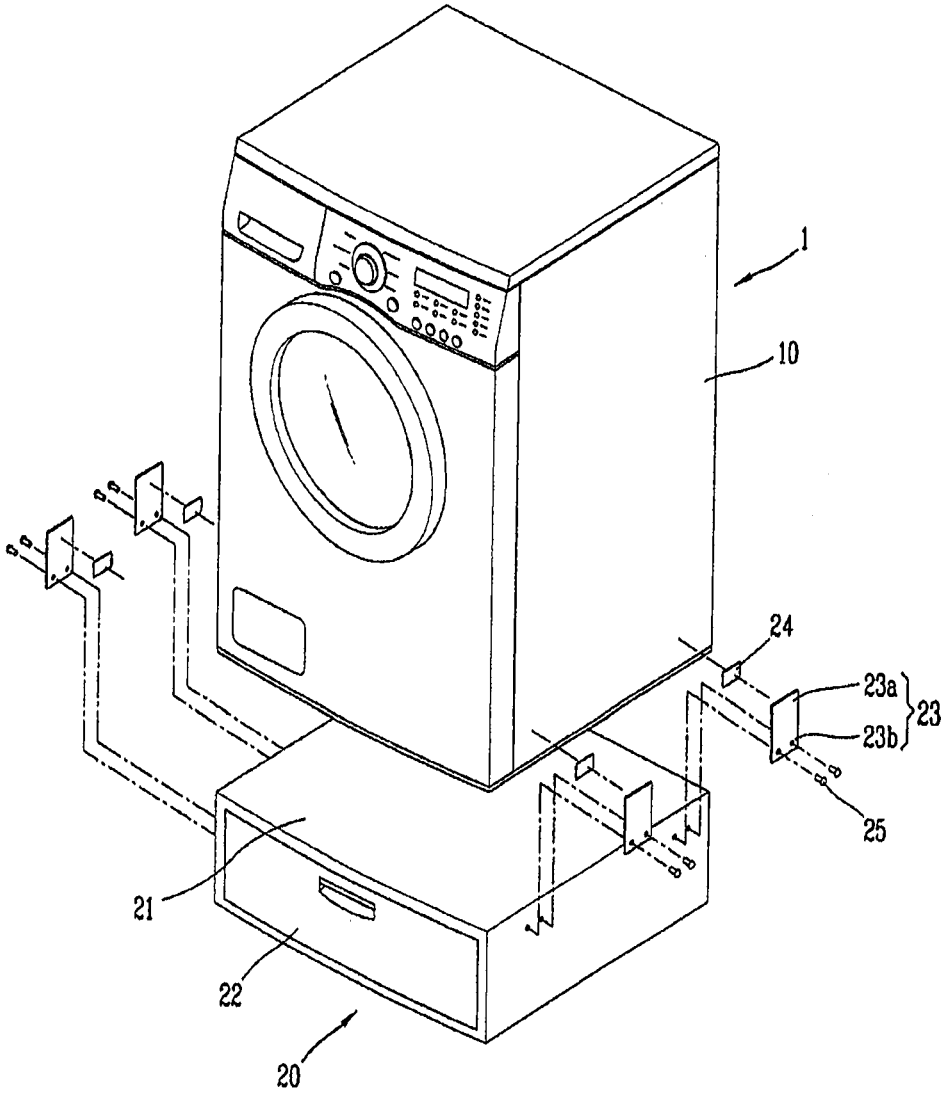
FIG. 1 is an exploded perspective view showing a washing/drying machine at which a pedestal is mounted in the related art.
Figure 2:
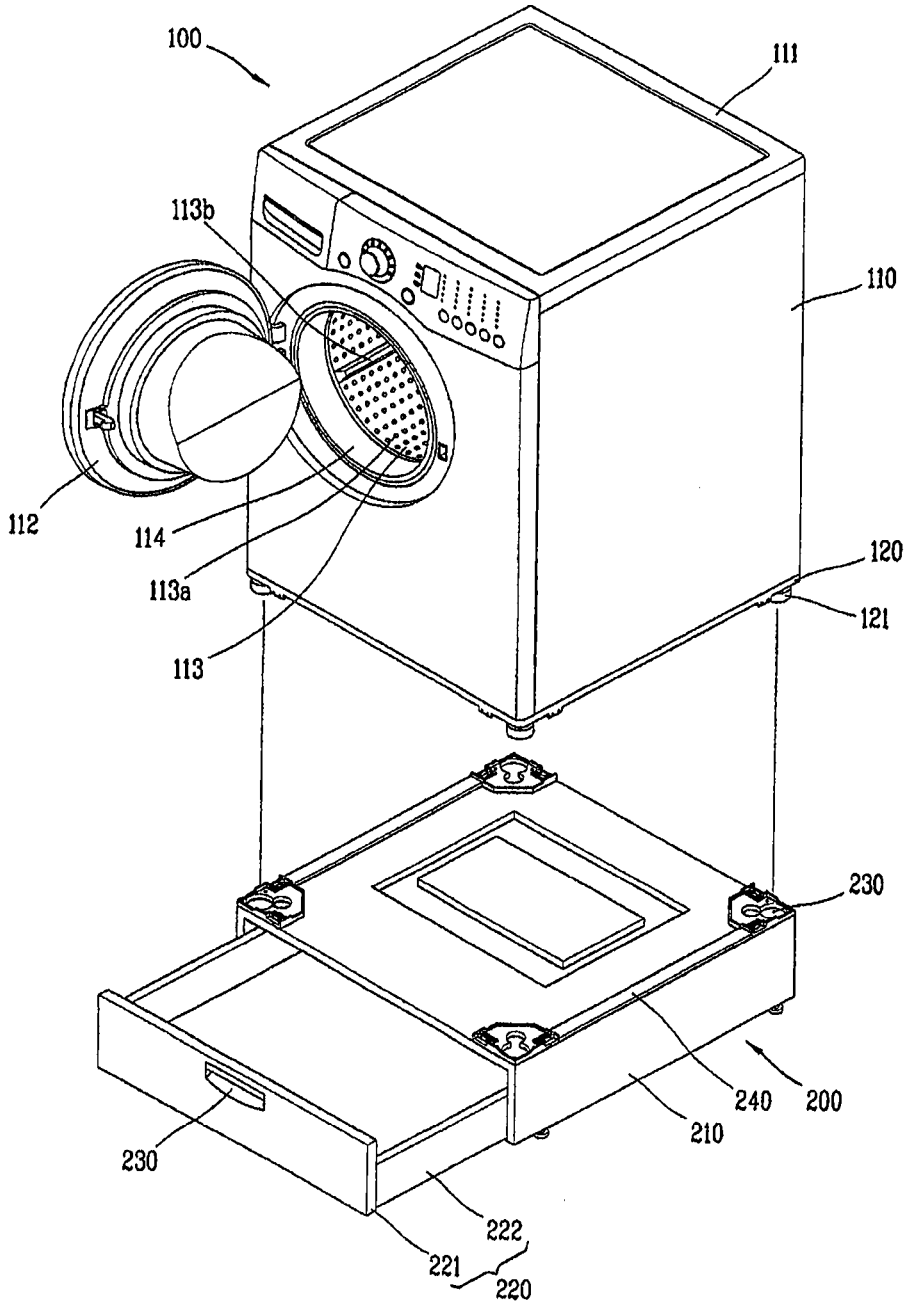
FIG. 2 is an exploded perspective view showing a washing/drying machine at which a pedestal is mounted in accordance with the present invention.
Figure 3:
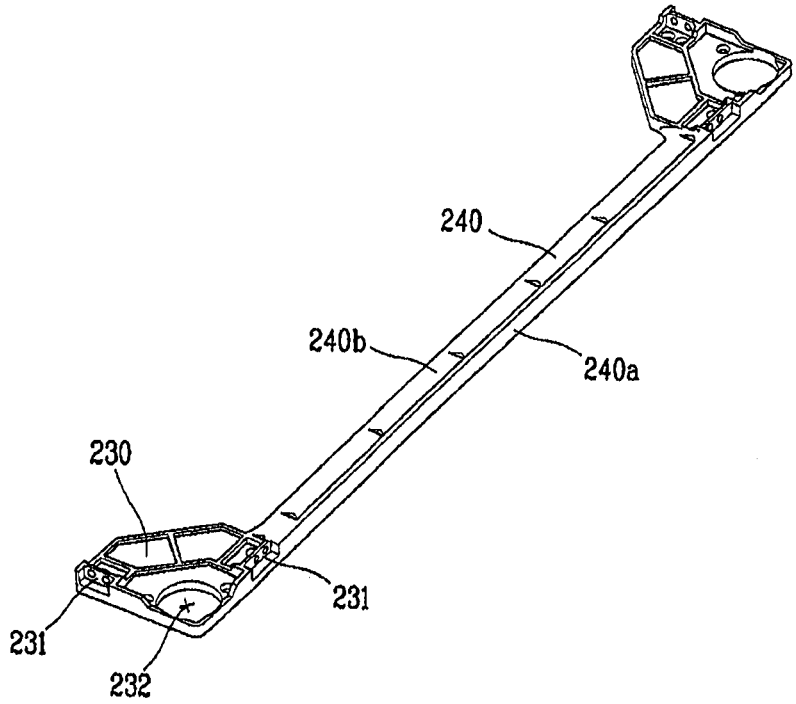
FIG. 3 is a perspective view showing a first exemplary embodiment of supporters and connection parts according to FIG. 2.
Figure 4:
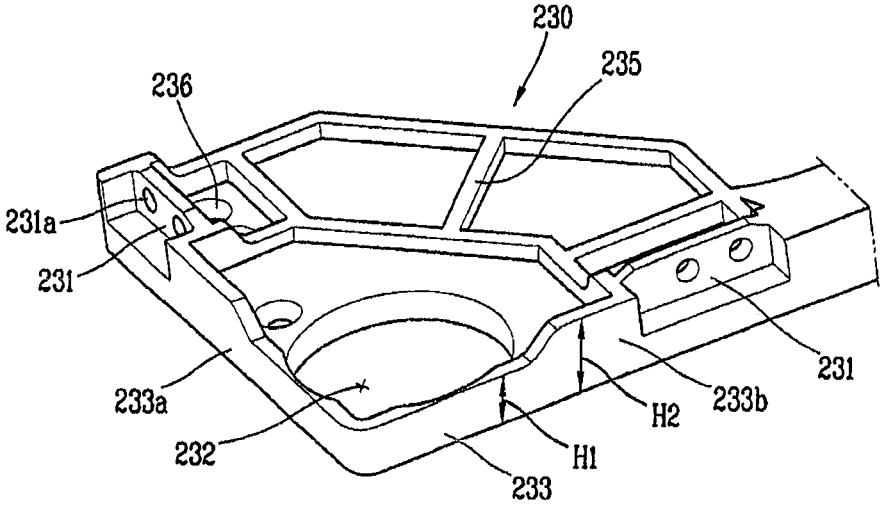
FIG. 4 is an enlarged perspective view showing the supporters of FIG. 3.

FIG. 2 is an exploded perspective view showing a washing/drying machine at which a pedestal is mounted in accordance with the present invention, FIG. 3 is a perspective view showing a first exemplary embodiment of supporters and connection parts according to FIG. 2 and FIG. 4 is an enlarged perspective view showing the supporters of FIG. 3.

As shown in FIG. 2, a washing/drying machine 100 according to the present invention includes a washing/drying machine main body 110 executing a washing operation for laundry, a pedestal 200 disposed at one side of the washing/drying machine main body 110 so as to store various items needed to washing the laundry therein, and supporters 230 and connection parts 240 installed between the pedestal 200 and the washing/drying machine main body 110 and serving to connect them to each other.

The washing/drying machine main body 110 may be implemented as one of a washing machine, a drying machine and a washing and drying machine. The pedestal 200 may be disposed on one side of a left side, a right side, an upper side and a lower side of the washing/drying machine main body 110. Preferably, the pedestal 200 is disposed at the lower side of the main body 110.

Hereafter, in the present invention, the pedestal 200 is disposed at the lower side of the main body 110 and the washing/drying machine main body 110 is implemented as the washing machine or the drying machine. That is, after mounting the pedestal 200 at a position where the washing/drying machine 100 is to be installed, the main body 110 of the washing/drying machine, that is, the washing machine or the drying machine, is fixed over the pedestal 200.

Here, the washing machine as an example of the washing/drying machine 100 includes the main body 110 forming an external appearance, a tub (not shown) horizontally installed in the main body 119 to be shock-absorbable and containing water therein, a drum 113 rotatably installed in the tub so as to contain polluted laundry therein and having an outer side surface provided with a plurality of passage holes 113*a* through which water or bubbles pass, a plurality of lifters 113*b* installed at an inner side surface of the drum 113 and lifting up the laundry so that the laundry can be dropped down from a specific height by gravity and a motor (not shown) installed at a rear portion of the tub and rotating the drum 113.

A main body cover (not shown) is mounted at the front surface of the main body 110. A base 120 is mounted at the lower surface of the main body 110. And, a top plate 111 is mounted on the upper surface of the main body 110.

The main body cover is provided with an opening through which the laundry is introduced into the drum 113 and a door 112 rotatably installed so as to open/close the opening. And, a gasket 114 is installed between the cover and the tub so as to absorb a shock caused by a rotation of the drum 113 and serve as a packing preventing water from flowing out.

Legs or height-adjusting legs 121 are ascendably installed at four edges of the base 120 so as to support a load of the main body 110 of the washing/drying machine (i.e., washing machine) and adjust a height thereof.

The legs 121 are coupled to the base 120 by coupling means such as screws. When rotated in one direction, the legs 121 are protruded from the base 120, thereby increasing an installation height of the washing/drying machine 100. When rotated in another direction, the legs 121 are inserted into the base 120, thereby reducing the installation height of the washing/drying machine 100.

The pedestal 200 includes a housing 210 formed in a box shape having a width enough to place the washing/drying machine 100 thereon and a storage drawer 220 formed at the front portion of the housing 210 to be drawable so as to store various items in the housing 210.

The housing 210 and the storage drawer 220 are formed by molding a plastic material in an injection manner.

Supporters 230 in which the legs 121 of the washing/drying machine 100 are respectively mounted are formed at four edges of the upper surface of the housing 210. And, legs (not shown) may be ascendably installed at four edges of the lower surface of the housing 210 so as to support the load the washing/drying machine 100 and the pedestal 200 and to adjust a height of the pedestal 200.

The storage drawer 220 includes a front portion 221 formed at the front surface of the housing 210 and provided with a handle 223 and a storage portion 222 formed at a rear side of the front portion 221 to be drawable from/to the inside of the housing 210 so as to store various items therein.

Thus, the pedestal 200 serves as a prop of the washing/drying machine 100 and as a storage place for storing various items such as detergent, conditioner, bleach, a fixing tool, a cleaning tool needed at the time of using the washing/drying machine 100.

Referring to FIGS. 3 and 4, the supporters 230 are installed on the housing 210 of the pedestal 200 and mounted at four edges of the upper surface of the housing 210, preferably.

The supporters 230 include a plurality of supporting plates 230*a* having leg guide holes 232 into which the legs 121 of the washing/drying machine 100, an object to be supported, are mounted, a plurality of coupling ribs 231 formed at each one side of the supporting plates 230*a* so as to couple the washing/drying machine 100 and the supporting plates 230*a* of the supporters to each other and connection parts 240 connecting the plurality of supporting plates 230*a* to each other.

Here, the leg guide holes 232 are configured to mount the legs of the washing machine therein or those of the drying machine according to whether the washing/drying machine 100 is implemented as the washing machine or the drying machine. And, when the washing/drying machine 100 is implemented as a refresher, legs of the refresher are mounted therein. That is, application of the leg guide holes 232 is not limited to the washing machine and drying machine.

Meanwhile, to generally utilize the supporters 230, at least two leg guide holes 232 may be formed.

The plurality of supporters or the supporter supporting plates 230*a* are connected to each other by the connection parts 240. The connection parts 240 are respectively formed in a bar shape having a specific length. The supporter supporting plates 230*a* and the connection parts 240 connected to each other are implemented in a "⊏" shape.

Each connection part 240 includes an external member 240*a* almost same as the surfaces of the washing/drying machine 100 and the pedestal 200 under a mounted state and an internal member 240*b* integrated with the external member 240*a* and formed inside of the external member 240*a*.

The external member 240*a* serves to shield a gap between the washing/drying machine 100 and the pedestal 200 by being vertically formed. The internal member 240*b* serves to support and fix the connection part 240 at the upper surface of the pedestal 200 by being horizontally formed. And, the internal member 240*b* may be provided with a coupling hole (not shown) for fixing the connection part 240 at the pedestal 200.

Here, the supporter supporting plates 230*a* and the connection parts 240 may be integrally formed. In case that the supporter supporting plates 230*a* and the connection parts 240 are integrated with each other, both sides are symmetric to each other on the basis of a center of the connection parts 240.

Meanwhile, the supporter supporting plate 230*a* may be explained in detail with reference to FIG. 4. As shown in FIG. 4, each supporter supporting plate 230*a* includes a first standard side surface 233*a* and a second standard side surface 233*b* forming external surfaces. One of the standard side surfaces 233*a*, 233*b* is same as the external surface of the external member 240*a* of the connection part 240.

And, the coupling ribs 231 are formed at the first standard side surface 233*a* and the second standard side surface 233*b*. The coupling ribs 231 serve to couple the supporters 230 or the pedestal 200 to the washing/drying machine 100. Here, it is effective that the coupling ribs 231 are formed at edges of the supporters 230 to correspond to edges of the upper surface of the housing 210 of the pedestal 200.

The first standard side surface 233*a* and the second standard side surface 233*b* are respectively provided with one coupling rib 231, preferably. However, in consideration of a size of the pedestal 200 or a size and a load of the washing/drying machine 100 installed over the pedestal 200, two coupling ribs 231 may be respectively formed at each standard side surface 233*a*, 233*b*.

The coupling ribs 231 are formed to be more inward than the standard side surfaces 233*a*, 233*b* by step heights with the first standard side surface 233*a* and the second standard side surface 233*b*, preferably. Accordingly, it is capable of preventing screw heads or bolt heads from being protruded more than the standard side surfaces 233*a*, 233*b* when coupling means such as screws or bolts are mounted in the coupling holes 231*a* formed at the coupling ribs 231 for coupling to the washing/drying machine 100.

Here, it is explained that the coupling ribs 231 are parallel with the first standard side surface 233*a* and the second standard side surface 233*b*, however, the coupling ribs 231 may be perpendicular to the first standard side surface 233*a* and the second standard side surface 233*b*. Because the shape of the coupling ribs 231 depends on the shape of the base side coupling ribs of the washing/drying machine 100 coupled to the coupling ribs 231.

The leg guide hole 232 is formed near a corner portion formed by the first standard side surface 233*a* and the second standard side surface 233*b* meeting together. A shield wall 233 encompasses the leg guide hole 232 so that the leg 121 of the washing/drying machine 100 mounted in the leg guide hole 232 cannot be exposed out.

Here, a height (H1) of the shield wall 233 is same as or lower than a height (H2) of the supporter supporting plate 230*a*. In case that the height (H1) of the shield wall 233 is same as that (H2) of the supporter supporting plate 230*a*, the leg 121 of the washing/drying machine 100 may not be exposed out. And, in case that the height (H1) of the shield wall 233 is lower than that (H2) of the supporter supporting plate 230*a*, the height of the leg 121 may be adjustable even under a state that the pedestal 200 is mounted at the washing/drying machine 100.

The leg guide hole 232 may be configured to be partially covered. Accordingly, it is capable of preventing the leg 121 of the washing/drying machine 100 from being outwardly exposed. Also, as the leg 121 of the washing/drying machine 100 is locked to the covered portion of the leg guide hole 232, it is capable of more firmly mounting the pedestal 200 at the washing/drying machine 100.

Coupling holes 236 for the coupling means for fixing the supporter supporting plate 230*a* at the pedestal 200 are formed at the supporting plate 230*a* of the supporter perpendicular to the coupling ribs 231. It is effective that a portion where the coupling holes 236 are formed to be sunken from the surface of the supporter supporting plate 230*a* in consideration of a thickness of the heads of the coupling means.

At least one reinforcing rib 235 is formed at the rear side of the leg guide hole 232. The reinforcing rib 235 serves to prevent hardness of the rear portion of the leg guide hole 232 from being degraded and to reduce the amount of the plastic molding material used to fabricate the supporter 230. That is, rear side portions of the leg guide hole 232 excluding the reinforcing rib 235 are formed to have relatively thin thickness so as to reduce the amount of the plastic molding material for the supporter 230.

Figure 5:
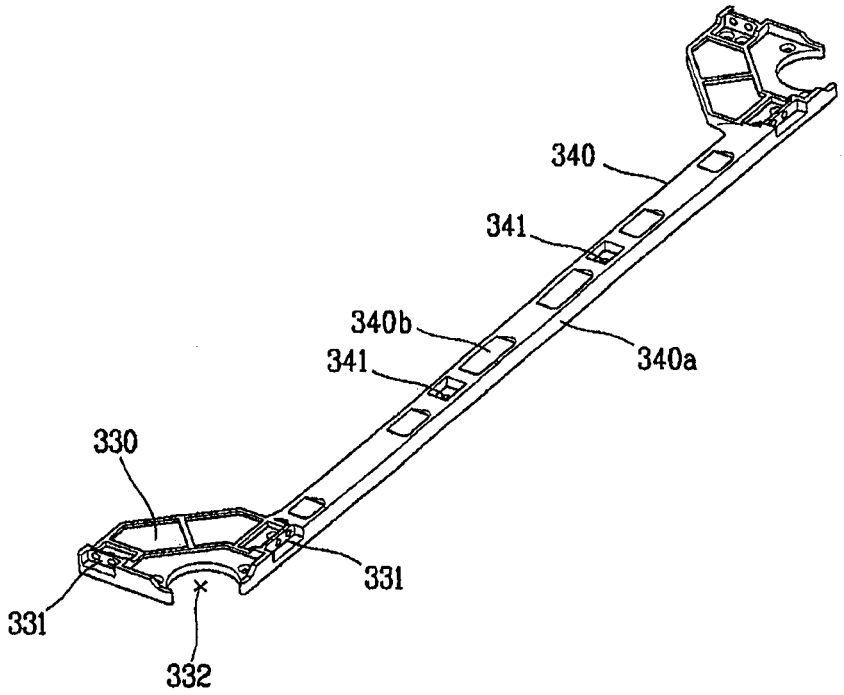
FIG. 5 is a perspective view showing a second exemplary embodiment of supporters and connection parts according to FIG. 2.
Figure 6:
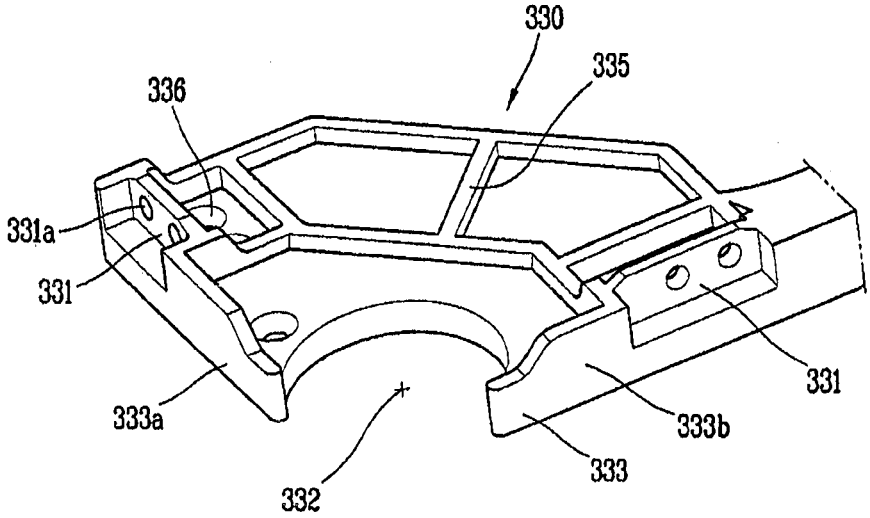
FIG. 6 is an enlarged perspective view showing the supporters of FIG. 5.

Meanwhile, FIG. 5 is a perspective view showing a second exemplary embodiment of supporters and connection parts according to FIG. 2 and FIG. 6 is an enlarged perspective view showing the supporters of FIG. 5.

Though the second embodiment of supporters 330 and connection parts shown in FIGS. 5 and 6 is almost same as the first embodiment shown in FIGS. 3 and 4, but shapes of the leg guide holes and the connection parts are different. Thus, they will be explained in detail.

Referring to FIG. 5, supporter supporting plates 330*a* formed at both sides and connection parts 340 connecting the supporter supporting plates 330*a* to each other are illustrated. Each connection part includes an external member 340*a* almost same as the surfaces of the washing/drying machine 100 and the pedestal 200 under a mounted state and an internal member 340*b* integrated with the external member 340*a* and formed inside of the external member 340*a*. At least two coupling holes 341 are formed at the internal member 340*b* of the connection part 340. Through the coupling holes 341, the internal member 340*b* is coupled to the pedestal 200.

Here, preferably, the thickness of portions where the coupling holes 341 are formed is less than that of other portions of the internal member 340*b*, in consideration of the thickness of the heads of the coupling means mounted in the coupling holes 341. Since the portions where the coupling holes 341 are formed are thin, stiffening ribs (not shown) may be formed at both sides of the portions where the coupling holes 341 are formed so as to prevent the hardness of the internal member 340*b* from being degraded.

Meanwhile, the leg guide hole 332 formed at the supporter supporting plate 330*a* has a partially opened portion. Referring to FIG. 6, coupling ribs 331 are formed at a first standard side surface 333*a* and a second standard side surface 333*b* and coupling holes 331*a* are formed at the coupling ribs 331, same as the first embodiment shown in FIG. 4. However, it is different that the leg guide hole 332 is partially opened and shield walls 333 partially encompass the leg guide hole 332.

As the leg guide hole 332 has the opened portion, it is capable of mounting the leg 121 in the leg guide hole 332 even when the leg 121 of the washing/drying machine 100 is formed to be slightly larger than the leg guide hole 332, thereby increasing applicability with respect to the leg 121 of the washing/drying machine 100. Here, the height of the leg guide hole 332 is same as or less than that of the supporter supporting plate 330*a*.

Unexplained reference numeral 336 denotes coupling holes and 335 denotes a reinforcing rib.

Figure 7:
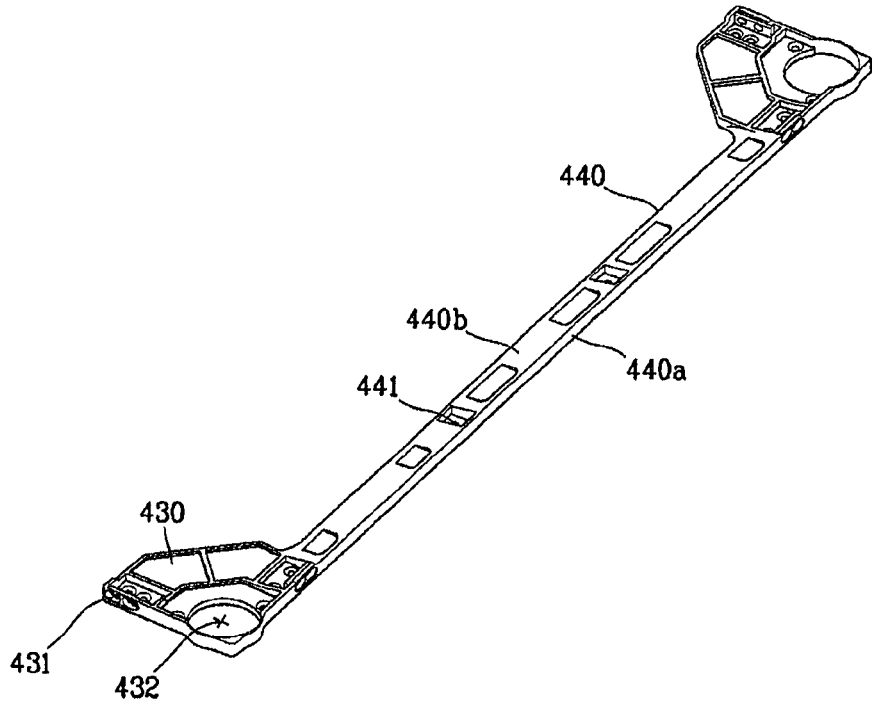
FIG. 7 is a perspective view showing a third exemplary embodiment of supporters and connection parts according to FIG. 2.

Hereafter, a third embodiment of supporters and connection parts will be explained. FIG. 7 is a perspective view showing the third exemplary embodiment of supporters and connection parts according to FIG. 2 and FIG. 8 is an enlarged perspective view showing the supporter 430 of FIG. 7.

Referring to FIG. 7, supporter supporting plates 430*a* formed at both sides and connection parts 440 connecting the supporter supporting plates 430*a* to each other are illustrated. Each connection part 440 includes an external member 440*a* almost same as the surfaces of the washing/drying machine 100 and the pedestal 200 under a mounted state and an internal member 440*b* integrated with the external member 440*a* and formed inside of the external member 440*a*. At least two coupling holes 441 are formed at the internal member 440*b* of the connection part 440. Through the coupling holes 441, the internal member 440*b* is coupled to the pedestal 200.

Here, preferably, the thickness of portions where the coupling holes 441 are formed is less than that of other portions of the internal member 440*b*, in consideration of the thickness of the heads of the coupling means mounted in the coupling holes 441. Since the portions where the coupling holes 441 are formed are thin, stiffening ribs (not shown) may be formed at both sides of the portions where the coupling holes 441 are formed so as to prevent the hardness of the internal member 440*b* from being degraded. The configuration of the connection part 440 is same as that of the connection part 340 shown in FIG. 5.

Figure 8:
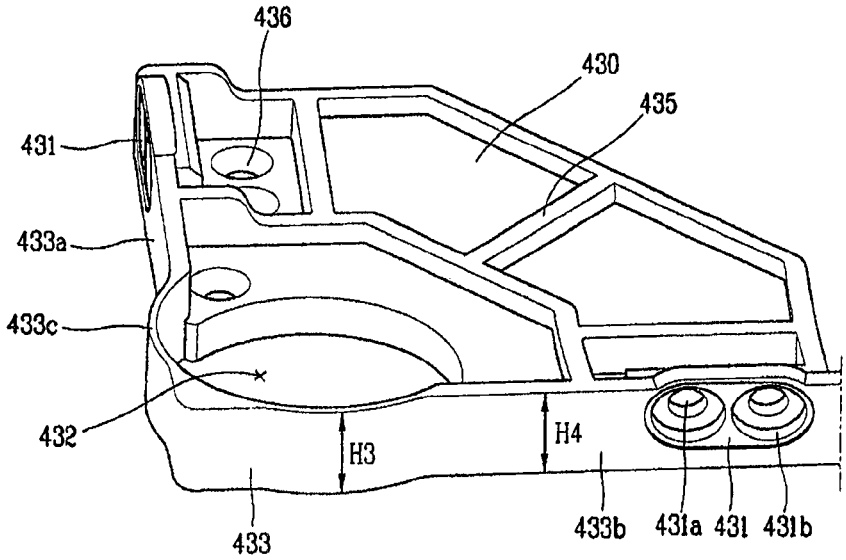
FIG. 8 is an enlarged perspective view showing the supporter of FIG. 7.

Meanwhile, as shown in FIG. 8, the supporter supporting plate 430*a* in accordance with the third embodiment of the present invention includes a leg guide hole 432 formed at an edge portion where a first standard side surface 433*a* and a second standard side surface 433*b* meet together, a reinforcing rib 435 formed at a rear side of the leg guide hole 432 so as to reduce the amount of a molding material at the time of molding process and to increase hardness of the supporter supporting plate 430*a* and coupling holes 436 for fixing the supporter supporting plate 430*a* at the pedestal 200.

Here, the leg guide hole 432 is encompasses by a shield wall 433. A part of the leg guide hole 432 or the shield wall 433 is outwardly protruded more than the first standard side surface 433*a* or the second standard side surface 433*b*. That is, a protrusion portion 433*c* is formed at a part of the shield wall 433. Since the protrusion portion 433*c* is formed, it is capable of reducing a size of the supporter supporting plate 430*a*.

And, a height (H3) of the shield wall 433 is same as a height (H4) of the supporter supporting plate 430*a*, accordingly it is capable of preventing the leg 121 of the washing/drying machine 100 from being outwardly exposed.

Meanwhile, coupling ribs 431 are formed along the first and second standard side surfaces 433*a*, 433*b*. The coupling ribs 431 have a configuration different from those of the coupling ribs 231, 331 in accordance with the first and second embodiments. That is, the entire coupling ribs 431 don't have step heights with the standard side surfaces 433*a*, 433*b*. Rather, only head mounting portions 431*b* for coupling means such as screws to be mounted into coupling holes 431*a* formed at the coupling ribs 431 are formed to be sunken.

The standard side surfaces 433*a*, 433*b* are formed to be more inward than the protrusion portion 433*c*. In this state, if the coupling ribs 431 are formed to be more inward than the standard side surfaces 433*a*, 433*b*, it may be inconvenient to mount the coupling means since the coupling ribs 431 are configured to be too much inward from the surface of the washing/drying machine 100 or the pedestal 200. Thus, it is effective that only head mounting portions 431*b* are configured to be sunken.

Hereafter, a base of the washing/drying machine 100 which is coupled to the coupling ribs 231 in accordance with the first embodiment will be explained in detail. The base 120 can be coupled to the coupling ribs 331, 431 in accordance with the second and third embodiment of the present invention.

Figure 9:
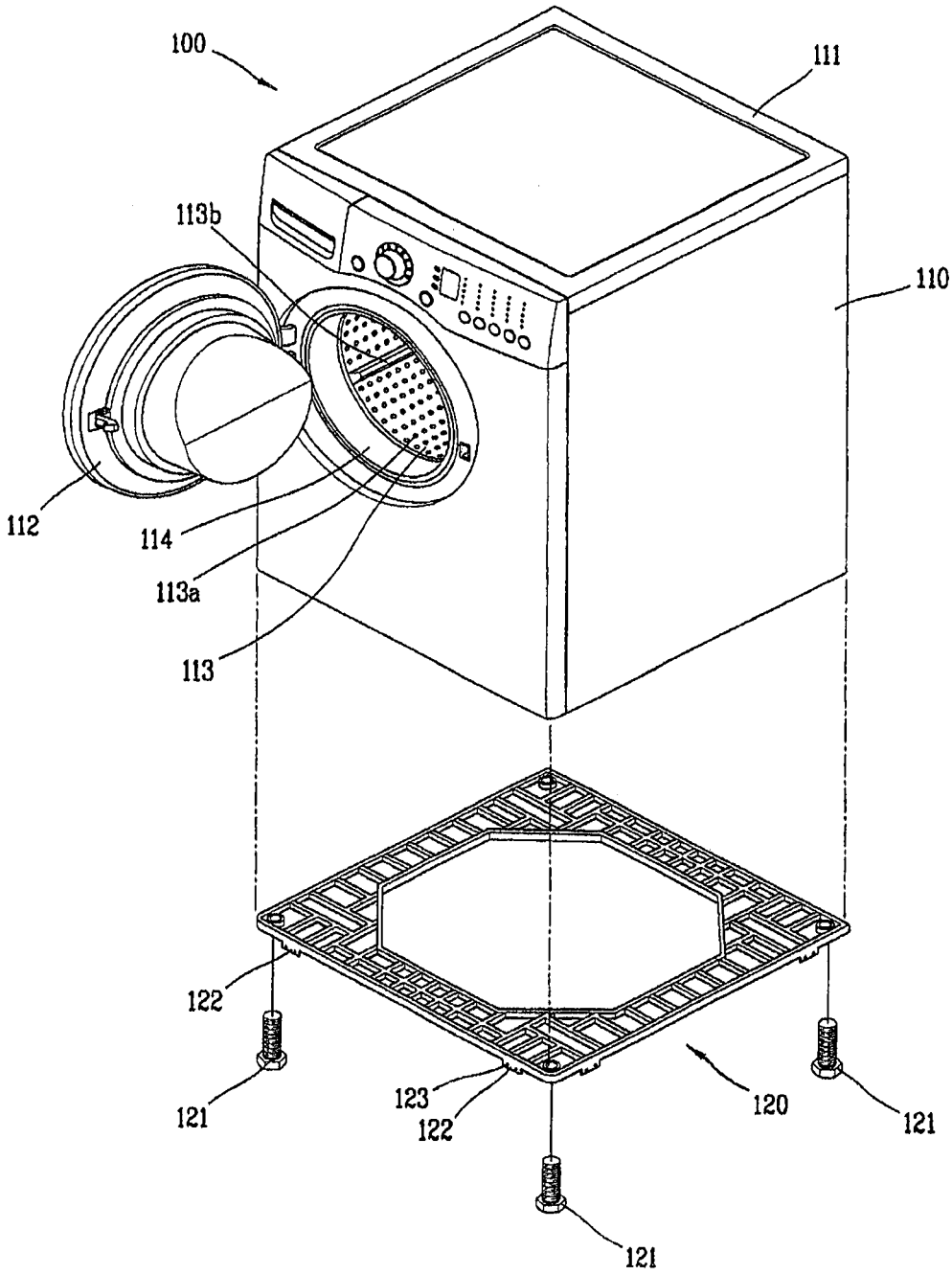
FIG. 9 is an exploded perspective view showing a base mounted at the washing/drying machine according to FIG. 2.
Figure 10:
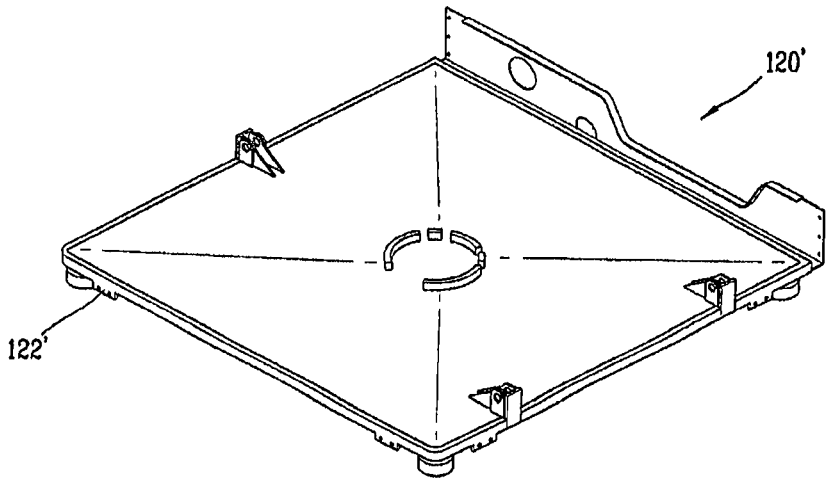
FIG. 10 is a perspective view showing a variation of the base according to FIG. 9.

FIG. 9 is an exploded perspective view showing the base mounted at the washing/drying machine according to FIG. 2 and FIG. 10 is a perspective view showing a variation of the base according to FIG. 9.

Referring to FIG. 9, the height-adjustable legs121 are mounted at four edges of the base 120 and base side coupling ribs 122 are formed at both sides based on the legs 121. The base side coupling ribs 122 are provided with coupling holes 123 communicated with the coupling holes 231*a* formed at the coupling ribs 231 of the supporters 230.

In order to mount the washing/drying machine 100 at the pedestal 200, the supporters 230 are interposed between the washing/drying machine 100 and the pedestal 200 and then coupling means such as screws are mounted in the coupling holes 123, 231*a* under a state that the coupling ribs 231 formed at the supporters 230 and the base side coupling ribs 122 are disposed to correspond to each other.

Here, the coupling ribs 231 of the supporters 230 may be disposed outside and the base side coupling ribs 122 may be disposed inside. And then, the coupling means such as screws are mounted in the coupling holes 123, 231*a* thereof so as to couple the coupling ribs 231 and the base side coupling ribs 122. Accordingly, the coupling ribs 122, 231*a* are not protruded more than the surface of the washing/drying machine 100 or the pedestal 200, thereby implementing an excellent external appearance. Also, it is not required to use an additional component such as a bracket in order to mount the washing/drying machine 100 or the pedestal 200 at the supporters 230.

And, it is capable of disposing the base side coupling ribs 122 at the outside and the coupling ribs 231 of the supporters 230 at the inside.

Here, the base 120 may be formed in a honeycomb shape or lattice shape as shown in FIG. 9, or may be implemented as a planar shape base 120' as shown in FIG. 10. Coupling ribs 122' are respectively formed at a lower surface of the planar shape base 120'.

The present applicant has explained the washing/drying machine with applying only to a washing machine and a drying machine, however the present invention is not limited thereto. The present invention can be applied to various washing/drying machines such as a washing and drying machine, a complex washing system and a refresher having a wrinkle removing function.

And, in description of the washing machine or the drying machine, the present invention is applied to a front loading type washing/drying machine in which the laundry is contained from the front side. However, a top loading type washing/drying machine in which the laundry is contained from the upper side is within a scope of the present invention.

It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. A washing/drying machine comprising:

a washing/drying machine main body executing washing or drying operation for laundry;

a base coupled to a lower end of the main body so as to support the main body and provided with legs; and a pedestal installed at a lower side of the main body and supporting the main body, wherein the pedestal has an upper surface provided with a plurality of supporters provided with coupling ribs for fixing the washing/drying machine main body at the pedestal and connection parts connecting the supporters mounted at one side of the pedestal to each other, wherein the coupling ribs are disposed laterally inside from a side surface of the main body, and wherein the base is provided with base side coupling ribs coupled to the coupling ribs of the supporters.

2. The washing/drying machine of claim 1, wherein the supporters mounted at one side of the pedestal and the connection parts are integrally formed.

3. The washing/drying machine of claim 2, wherein each supporter is provided with a leg guide hole for receiving the leg and a shield wall so as to prevent the leg from being exposed out.

4. The washing/drying machine of claim 1, wherein each supporter is provided with a leg guide hole for receiving the leg and a shield wall so as to prevent the leg from being exposed out.

5. The washing/drying machine of claim 4, wherein the leg guide hole is partially protruded more than the shield wall.

6. The washing/drying machine of claim 4, wherein the leg guide hole is partially opened.

7. The washing/drying machine of claim 4, wherein the connection parts serve to shield a gap between the pedestal and the main body.

* * * * *